US012264905B2

(12) United States Patent
Hucker

(10) Patent No.: US 12,264,905 B2
(45) Date of Patent: Apr. 1, 2025

(54) APPARATUS AND METHOD SUITABLE FOR USE WITH A MUNITION

(71) Applicant: BAE SYSTEMS plc, London (GB)

(72) Inventor: Martyn John Hucker, Monmouthshire (GB)

(73) Assignee: BAE SYSTEMS PLC, London (GB)

( * ) Notice: Subject to any disclaimer, the term of this patent is extended or adjusted under 35 U.S.C. 154(b) by 9 days.

(21) Appl. No.: 18/548,376

(22) PCT Filed: Feb. 28, 2022

(86) PCT No.: PCT/GB2022/050526
§ 371 (c)(1),
(2) Date: Aug. 30, 2023

(87) PCT Pub. No.: WO2022/185034
PCT Pub. Date: Sep. 9, 2022

(65) Prior Publication Data

US 2024/0133665 A1 Apr. 25, 2024
US 2024/0230299 A9 Jul. 11, 2024

(30) Foreign Application Priority Data

Mar. 4, 2021 (EP) ..... 21275022
Mar. 4, 2021 (GB) ..... 2103038

(51) Int. Cl.
*F42C 15/40* (2006.01)
*F42C 11/06* (2006.01)
*F42C 17/04* (2006.01)

(52) U.S. Cl.
CPC ..... *F42C 15/40* (2013.01); *F42C 11/065* (2013.01); *F42C 17/04* (2013.01)

(58) Field of Classification Search
CPC ..... F42C 15/40; F42C 11/065; F42C 17/04
USPC ..... 102/206
See application file for complete search history.

(56) References Cited

U.S. PATENT DOCUMENTS

| | | | | |
|---|---|---|---|---|
| 3,742,857 | A | 7/1973 | Schmidt et al. | |
| 9,625,243 | B1 * | 4/2017 | Haddon | F42C 15/40 |
| 11,287,237 | B1 * | 3/2022 | Pirozzi | F42C 15/24 |
| 2009/0013891 | A1 * | 1/2009 | Rastegar | F42C 11/02 102/210 |
| 2012/0180681 | A1 * | 7/2012 | Rastegar | F42C 15/24 102/209 |

(Continued)

FOREIGN PATENT DOCUMENTS

WO 2022185034 A1 9/2022

OTHER PUBLICATIONS

International Search Report and Written Opinion received for PCT Application No. PCT/GB2022/050526. Mail Date: May 31, 2022. 12 pages.

(Continued)

*Primary Examiner* — Samir Abdosh
(74) *Attorney, Agent, or Firm* — Finch & Maloney PLLC

(57) ABSTRACT

According to an aspect of the invention, there is provided a fuze arming system for a munition, comprising: an arming circuit arranged to detect a setback event and, in response to the setback event, generate a signal indicating that an arming event has occurred, wherein the arming circuit comprises a sensor configured to produce a graduated output when the setback event occurs, and fuze arming system is arranged to use that graduated output.

20 Claims, 3 Drawing Sheets

(56) References Cited

U.S. PATENT DOCUMENTS

Figure 1:
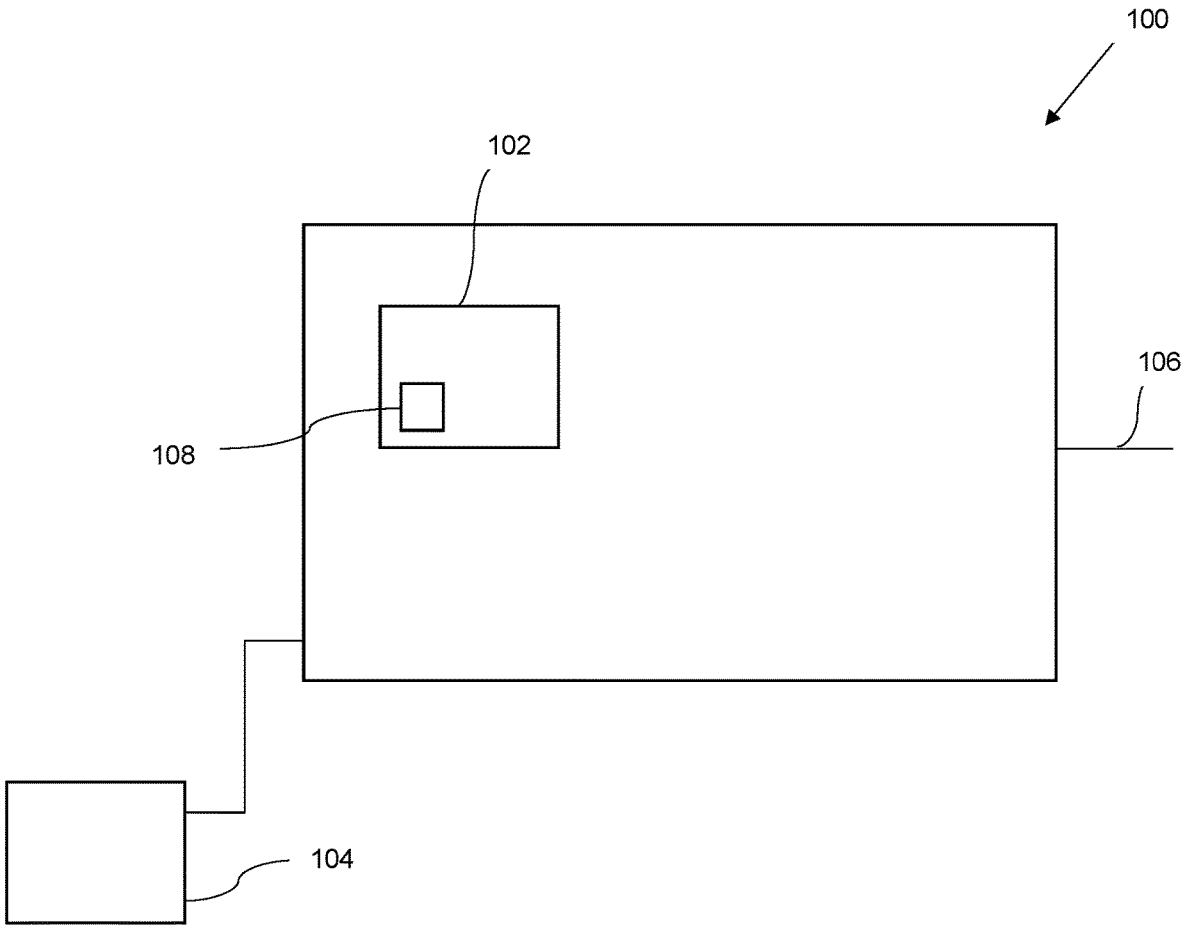

| | | | | |
|---|---|---|---|---|
| 2012/0180682 | A1* | 7/2012 | Rastegar | F42C 15/40 102/209 |
| 2012/0291650 | A1* | 11/2012 | Aw | F42C 11/00 102/207 |
| 2013/0180423 | A1 | 7/2013 | Rastegar et al. | |
| 2014/0060366 | A1* | 3/2014 | Rastegar | F42C 11/00 102/206 |
| 2018/0031357 | A1 | 2/2018 | Rastegar et al. | |

OTHER PUBLICATIONS

Extended European Search Report received for EP Application No. 21275022.8, dated Sep. 10, 2021. 7 pages.
GB Search Report under Section 17(5) received for GB Application No. 2103038.2, dated Dec. 1, 2021. 3 pages.

* cited by examiner

APPARATUS AND METHOD SUITABLE FOR USE WITH A MUNITION

The present invention relates generally to a fuze arming system for a munition, such as a munition or munition assembly that is adapted to be launched, into the air, from a gun barrel. A related munition and method are also provided.

Munitions are provided in a number of different forms, for a number of different applications. Typically, a particular munition will be used for a particular application or intention. For the purposes of this patent application, munitions are taken to include but are not limited to artillery shells and charges, missiles, rockets, and mortar rounds, as well as small arms munitions such as bullets.

Safety and arming units are utilised in munitions to prevent inadvertent or accidental detonation of explosive material within the munitions during routine handling or in the launcher, as well as during the initial flight. The safety and arming units are typically part of a munition's fuze and prevent arming of the fuze until certain conditions are met. An example of such condition may be setback acceleration associated with the launching of the munition. However, not all safety and arming units are able to measure setback, or measure it in a safe way, and hence cannot exploit this as an arming environment. This limitation is due to the fact that peak acceleration of artillery, mortar and tank rounds typically occurs before a power source of the munition has fully activated. Electronic sensors that depend on electrical power to operate are therefore unable to detect this event.

Whilst a number of alternative environments can be exploited in order to arm the fuze, the ability to detect setback (as per mechanical fuzes) would increase design flexibility and provide a robust additional or alternative safety feature which may allow electronic fuzing to be more widely applied across a greater range of munition types. A different approach is therefore required in order to allow an electronic safety and arming unit to detect setback events that occur before a separate power supply (e.g. a power supply of the munition) is available.

It is an example aim of example embodiments of the present invention to at least partially avoid or overcome one or more disadvantages of the prior art, whether identified herein or elsewhere, or to at least provide a viable alternative to existing apparatus and methods.

According to a first aspect of the invention, there is provided a fuze arming system for a munition, comprising: an arming circuit arranged to detect a setback event and, in response to the setback event, generate a signal indicating that an arming event has occurred, wherein the arming circuit comprises a sensor configured to produce a graduated output when the setback event occurs, and fuze arming system is arranged to use that graduated output. Thus, the setback event can be utilised to provide a graduated output for use by the fuze arming system.

The graduated output may be used for arming a fuze, and/or programming a fuze, the fuze being in connection with or forming part of the fuze arming system. Thus, the graduated output can be utilised by the fuze arming system in order to arm the fuze, and/or program the fuze in response to the detected setback event.

A graduation of the graduated output may be proportional to a degree of setback detected during the setback event. Thus, the graduation can be used to (e.g. additionally) indicate conditions characteristic to a specific setback event, further enhancing the utility of the fuze arming system.

The graduation of the graduated output may be used for providing (e.g. graduated, non-binary) information on launch conditions of the munition. Thus, the graduated output can be used to provide (e.g. graduated, non-binary) information on the prevailing launch conditions (e.g. charge increment, approximate muzzle velocity). In other words, the output is not just used to detect launch or no launch. The information is more granular and subtle, and is graduated. This means that the information is proportional to the graduated output, for example a launch speed, acceleration or velocity, or a fuze time setting, or anything non-binary, etc. The information is used for functionality after launch.

The graduated output may be used for programming a fuze, in addition to simply detecting launch (and/or arming of the fuze). This means that additional functionality can be extracted and utilised. This means that post-launch functionality can be improved, by using the graduated output. In other words, the output is not just being used to detect launch or no launch.

The graduated output may be used for programming a post-launch arming delay of the fuze. This is not possible if launch is detected in a binary (launch, no launch) manner. The graduated output of course allows the arming delay to be proportional to the graduation.

The launch condition may comprise an approximate muzzle velocity. Again, this is not possible if launch is detected in a binary (launch, no launch) manner. The graduated output of course allows the muzzle velocity to be detected or determined in a manner that is proportional to the graduation.

The sensor may comprise a solid-state sensor, optionally a piezoelectric sensor, or a magnetostrictive sensor. The advantage of using a solid-state sensor is that the solid-state sensor exhibits suitable shock/g-force resistance. Furthermore, as both the piezoelectric and magnetostrictive sensor convert mechanical strain directly to electrical charge and hence do not require a power source (external to and separate from the solid-state sensor) to operate, thus addressing the issue of being able to use the sensor before the power source has fully activated.

The sensing axis of the sensor may be aligned with a main acceleration axis of the munition. A sensor arranged with its sensing axis aligned with the main acceleration axis of the munition generates a charge proportional to the applied strain and the strain in turn is proportional to the magnitude of acceleration.

The arming circuit may further comprise a capacitor arranged to store a voltage corresponding to the output generated by the sensor. Thus, the capacitor facilitates the conversion of the output generated by the sensor to a voltage.

The arming circuit may further comprise a comparator circuit arranged to compare the voltage stored by the capacitor with a threshold value to verify whether an arming event has occurred. Thus, a simple, reliable mechanism for verifying whether an arming event has occurred can be provided.

The arming circuit may further comprise a rectifier. Thus, charging under accelerations of the wrong polarity is prevented, reducing the risk of a false positive indication that an arming event has occurred.

The arming circuit may further comprise a bleeder resistor. Thus, the storage time of the capacitor can be limited, therefore preventing potential interference or errors due to acceleration events experienced prior to firing.

In response to verifying that an arming event has occurred, the arming circuit may output a signal to arm the fuze. Thus, the fuze can be armed in a safe and effective manner.

The fuze may comprise an electronic fuze. Electronic fuzes can, in general, be safer than mechanical alternatives.

The sensor may be configured to generate a charge when the setback event occurs. Thus, the fuze arming system can react in response to the setback event.

The sensor may be configured to produce the graduated output before a power source (e.g. external to and separate from the sensor) of the munition is activated. Thus, a graduated output can be produced before power from the power source is available. Additionally, the power source is optionally not needed to probe or interrogate the sensor before, at, or immediately after launch.

According to a second aspect of the invention, there is provided a munition comprising the fuze arming system described herein. Thus, a setback event can be detected before a separate (e.g. external to and separate from the sensor) power supply becomes available, increasing design flexibility and providing a robust additional safety feature for arming the fuze of a munition.

The munition may comprise a small arms munition. Thus, the fuze arming system can be applied to a wide range of munitions, from artillery charges to small arm munitions.

According to a third aspect of the invention, provided is a fuze arming method for a munition, the method comprising: detecting a setback event, generating a signal that an arming event has occurred, and, in response to the setback event occurring, producing a graduated output, and using that graduated output. Thus, a graduated output can be produced in response to the detected setback event can be detected before a separate power supply becomes available, increasing design flexibility and providing a robust additional safety feature for arming the fuze of a munition.

According to a fourth aspect of the invention, there is provided a fuze arming system for a munition, comprising: an arming circuit arranged to detect a setback event and, in response to the setback event, generate a signal indicating that an arming event has occurred, wherein the arming circuit comprises a solid-state sensor configured to generate a charge when the setback event occurs. Thus, a setback event can be detected before a separate power supply becomes available, increasing design flexibility and providing a robust additional safety feature for arming the fuze of a munition.

The solid-state sensor may comprise a piezoelectric sensor. As piezoelectric sensor converts mechanical strain directly to electrical charge and hence does not require a power source to operate, thus addressing the issue of being able to use the sensor before the power source has fully activated.

The solid-state sensor may comprise a magnetostrictive sensor. A magnetostrictive sensor also converts mechanical strain directly to electrical charge and hence does not require a power source to operate, thus addressing the issue of being able to use the sensor before the power source has fully activated.

The sensing axis of the solid-state sensor may be aligned with a main acceleration axis of the munition. A solid-state sensor arranged with its sensing axis aligned with the main acceleration axis of the munition generates a charge proportional to the applied strain and the strain in turn is proportional to the magnitude of acceleration.

The arming circuit may further comprise a capacitor arranged to store a voltage corresponding to the charge generated by the solid-state sensor. Thus, the capacitor facilitates the conversion of the charge generated by the solid-state sensor to a voltage.

The arming circuit may further comprise a comparator circuit arranged to compare the voltage stored by the capacitor with a threshold value to verify whether an arming event has occurred. Thus, a simple, reliable mechanism for verifying whether an arming event has occurred can be provided.

The arming circuit may further comprise a rectifier. Thus, charging under accelerations of the wrong polarity is prevented, reducing the risk of a false positive indication that an arming event has occurred.

The arming circuit may further comprise a bleeder resistor. Thus, the storage time of the capacitor can be limited, therefore preventing potential interference or errors due to acceleration events experienced prior to firing.

In response to verifying that an arming event has occurred, the arming circuit may output a signal to arm the fuze. Thus, the fuze can be armed in a safe and effective manner.

The fuze may comprise an electronic fuze. Electronic fuzes can, in general, be safer than mechanical alternatives.

The solid-state sensor may be configured to produce a graduated output. The graduated output can be used to provide information on the prevailing launch conditions (e.g. charge increment, approximate muzzle velocity).

The solid-state sensor may be configured to generate the charge before a power source (e.g. external to and separate from the solid-state sensor) of the munition is activated. Thus, a setback event can be detected before power from the power source is available.

According to a fifth aspect of the invention, there is provided a munition comprising the fuze arming system described herein. Thus, a setback event can be detected before a separate power supply becomes available, increasing design flexibility and providing a robust additional safety feature for arming the fuze of a munition.

The munition may comprise a small arms munition. Thus, the fuze arming system can be applied to a wide range of munitions, from artillery charges to small arm munitions.

According to a sixth aspect of the invention, provided is a fuze arming method for a munition, the method comprising: detecting a setback event, generating a signal that an arming event has occurred, and, in response to the setback event occurring, generating a charge by a solid-state sensor. Thus, a setback event can be detected before a separate power supply becomes available, increasing design flexibility and providing a robust additional safety feature for arming the fuze of a munition.

More generally, any one or more features described in relation to any one aspect may be used in combination with, or in place of, any one or more feature of any one or more other aspects of the invention, unless such replacement or combination would be understood by the skilled person to be mutually exclusive, after a reading of the present disclosure.

Figure 2:
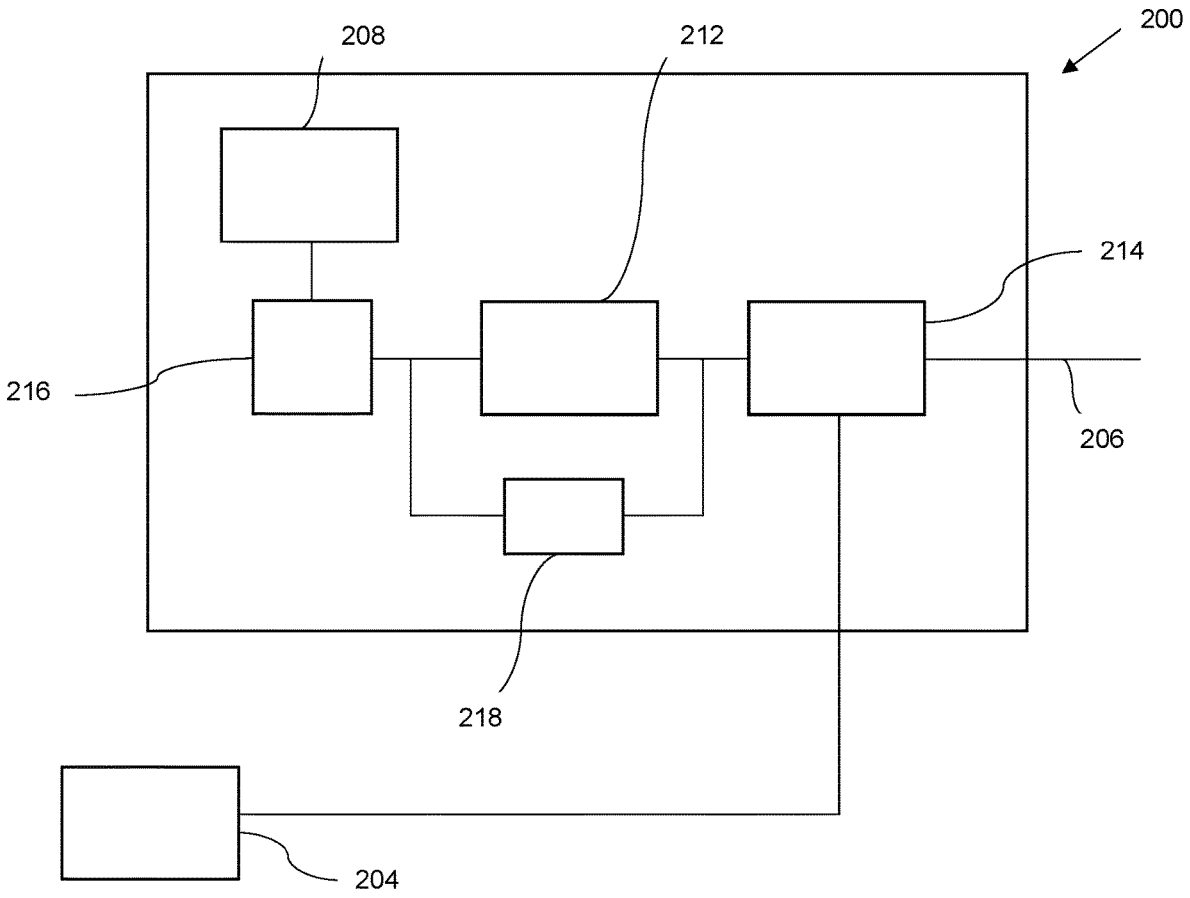
Figure 3:
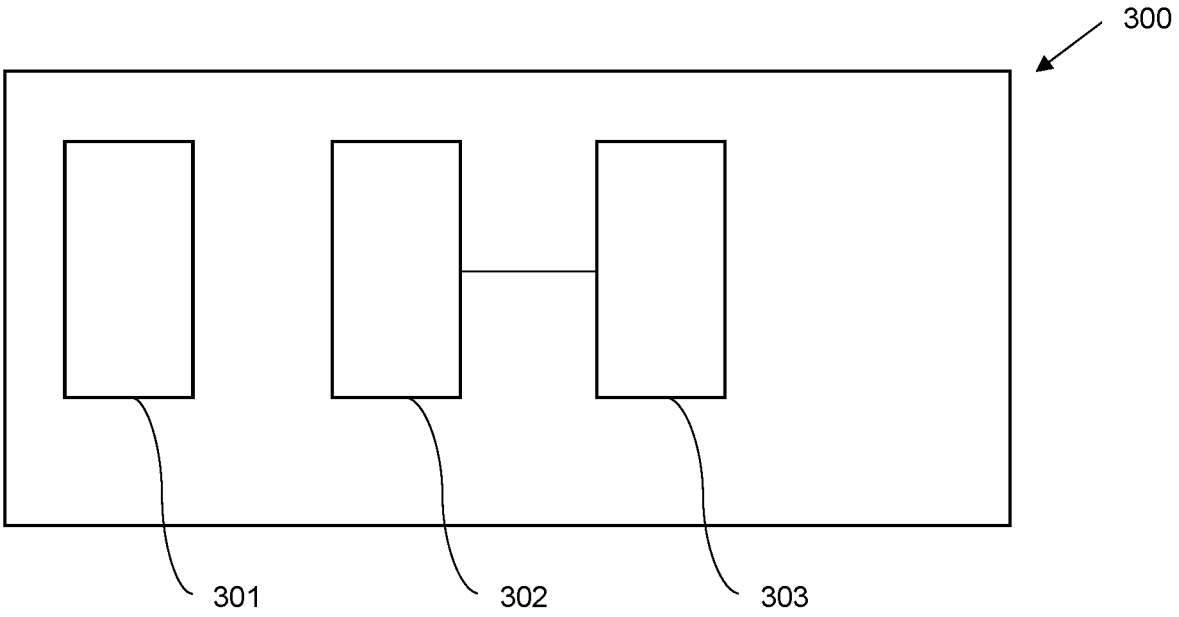
Figure 4:
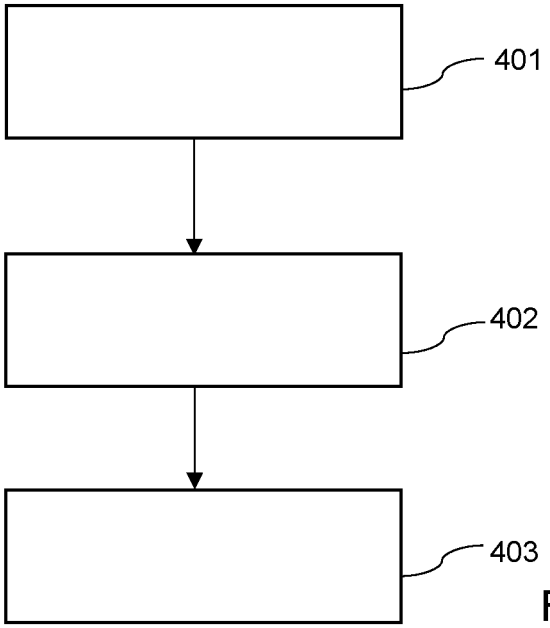

For a better understanding of the invention, and to show how embodiments of the same may be carried into effect, reference will now be made, by way of example, to the accompanying diagrammatic Figures in which:

FIG. 1 schematically depicts a fuze arming system, in accordance with an example embodiment;

FIG. 2 schematically depicts an arming circuit, in accordance with an example embodiment;

FIG. 3 schematically depicts a munition comprising the fuze arming system, in accordance with an example embodiment;

FIG. 4 schematically depicts a fuze arming method for a munition, in accordance with an example embodiment.

As discussed above, there are numerous disadvantages associated with existing apparatus and fuze arming methods for munitions. These range from the inability to detect setback events that occur before its electrical power supply is available, to the limited design flexibility, or the significant expense associated with existing fuze arming systems. In general, there is exists no relatively inexpensive, flexible design that would provide a robust additional or alternative safety feature which may allow a particular type of fuzing, for example electronic fuzing, to be applied more safely, or more widely across a greater range of munition types, ranging anywhere from artillery shells to 5.56 mm bullets.

According to the present disclosure, it has been realised that the problems associated with existing approaches can be overcome in an inexpensive but effective manner. In particular, the present disclosure provides a fuze arming for a munition. The munition comprises an explosive charge and a fuze. The munition is adapted to be launched, into the air. Importantly, the munition may be adapted to be launched from a gun barrel. This means that the munition typically (and practically likely) includes, or is at least used in conjunction with, a propelling explosive, and is capable of being explosively propelled and withstanding such explosive propulsion.

The munition will typically be a projectile, therefore being unpropelled and/or including no form of self-propulsion. This means that the munition is relatively simple and inexpensive.

FIG. 1 schematically depicts a fuze arming system in accordance with an example embodiment. In this example, the fuze arming system 100 for a munition comprises an arming circuit 102 arranged to detect a setback event. The setback force is the rearward force of inertia resulting from the forward acceleration of a projectile (in this case, a munition) during its launching phase, applied in the direction along of the path of travel of the projectile. That is, the setback force is the force generated as the munition is initially accelerated. At least two separate environments must be detected in order to permit arming. Mechanical artillery fuzes typically use separate, independent mechanisms to detect setback and spin. Rotational arming requires that a munition reaches a certain rpm before an arming event occurs. Thus, by detecting a setback event, and using that to indicate that an arming event has occurred, earlier arming or safer might be achieved. Arming based on setback is beneficial in situations where early arming is required—for example, when the munition has a relatively short distance to travel to the target.

In response to detecting the setback event, the arming circuit 102 is configured to generate a signal indicating that an arming event has occurred. Throughout this specification, an arming event will be understood as an event representing a point in time at which the fuze may be armed; for example, the munition reaching its peak acceleration. It is noted that a plurality of different arming events might be required before the fuze is armed, in order to improve safety of the munition. This does not necessarily mean that the fuze can trigger an explosive charge, based on the detection of the setback event, and/or generation of the signal indicating that the arming event has occurred. Other conditions may need to be met. Important is that the generation of the signal indicating that the arming event has occurred may occur before a power source 104 of the system is fully activated. In other words, setback occurs, and is detected, before the power source 104 is usable or able to provide power to sensing or processing electronics. This is because a power source 104 of a munition is often itself triggered to be in an active or suitably power-supplying state based on launch of the munition. For example, component parts of the power source 104 may move or change state as the munition is launched, and this movement or state change moves the power source 104 to a power-supplying state. However, this takes time, and means that anything within or before that time simply cannot be detected by any sensor powered by that power supply.

The signal generated by the arming circuit 102 might be outputted via the output 106, and fed to another element of the fuze arming system, or another element of the munition, for example a control module within the munition.

In the example depicted in FIG. 1, the arming circuit 102 comprises a sensor 108 configured to produce a graduated output when the setback event, and the fuze arming system 100 is arranged to use that graduated output. The graduated output is used for arming a fuze, and/or programming a fuze, the fuze being in connection with or forming part of the fuze arming system 100. A graduation of the graduated output is proportional to a degree of setback detected during the setback event. In particular, the graduation of the graduated output is used for providing information on launch conditions of the munition, for example charge increment, which might or relate to an equivalent approximate muzzle velocity, corresponding to the detected degree of setback. Advantageously, the sensor 108 is configured to produce the graduated output before the power source 104 of the munition is activated.

In one example, said graduated output is used by the arming circuit 102 for generating the signal indicating that an arming event has occurred. The sensor 108 comprises anything that is able to generate a charge from a change in pressure (e.g. stress or strain) on the sensor—typically, this is a solid-state sensor, such as a piezoelectric sensor, or a magnetostrictive sensor, or a combination thereof. The advantage of the aforementioned sensors is that they do not require an external power source to operate—for example, a piezoelectric sensor converts mechanical strain directly to electrical charge and thus does not require a power source to operate. A magnetostrictive sensor also change in mechanical energy to changes in electromagnetic energy. Thus, the sensor 108 is able to produce a graduated output when the setback event occurs, before a separate (e.g. external to and separate from the sensor 108) power source 104 becomes available. The fact that the sensor 108 does not require power from the separate power source 104 is particularly useful also for detecting peak acceleration of certain types of munitions, for example artillery munitions, as typically the peak acceleration of an artillery munition occurs before the separate power source 104 of the munition is fully activated.

A sensing axis of the sensor 108 is aligned with a main (e.g. longitudinal) acceleration axis of the munition such as to generate a graduated output proportional to the applied strain. The strain, in turn, is proportional to the magnitude of acceleration of the munition.

FIG. 2 schematically depicts an arming circuit, in accordance with an example embodiment. It will be appreciated that the arming circuit 200 of FIG. 2 is the same as the arming circuit 102 of FIG. 1. The arming circuit 200 comprises a sensor 208. Detailed description of the sensor 208 will be omitted as it will be appreciated that the sensor 208 of FIG. 2 is the same as the sensor 108 of FIG. 1.

A charge generated by the sensor 208 is converted to a voltage via the use of a capacitor 212. The capacitor behaves in a manner analogous to mathematical integration and thus the charge output from the setback event results in a distinct voltage magnitude being recorded on the capacitor 212.

When a separate power source 204 (equivalent to the separate power source 104 of FIG. 1) becomes available later, the voltage on the capacitor 212 can be interrogated via a high impedance comparator circuit 214 and, if the voltage is of the correct magnitude, this can be used to indicate that a valid arming event has occurred. That is, the comparator circuit 214 is arranged to compare the voltage stored by the capacitor 212 with a threshold value. The output of the comparator circuit 218 is depicted schematically as output 206. The output 206 is equivalent to the output 106 of FIG. 1.

The arming circuit 200 further comprises a rectifier 216, located between the sensor 208 and the capacitor 212, intended to prevent charging under accelerations of the wrong polarity, thus further enhancing the safety of the fuze arming system, as accelerations of the wrong polarity will not be falsely interpreted as a setback event. In one example, the rectifier 216 comprises a rectifying diode. The arming circuit 200 also comprises a bleed resistor 218, connected in parallel with the capacitor 212, arranged to limit the storage time to a few tens of milliseconds and hence prevents potential interference and/or errors due to acceleration events experienced prior to firing, once again enhancing the safety of the fuze arming system.

While the magnitude of the integrated setback voltage stored by the capacitor 212 has so far been described as used for indicating that a setback event has occurred, it will be appreciated that other uses are also possible. In one example, the charge generated by the sensor 208 is converted by the capacitor 212 in order to produce a graduated output. For example, the magnitude of the integrated setback voltage may be used to provide information on the prevailing launch conditions, such as charge increment which might or relate to an equivalent approximate muzzle velocity. This graduated voltage output can be used to actively manage factors such as post-launch arming delay to allow safe separation distance to be relatively independent of charge increment, shell type, and other such factors. In one embodiment, the graduated output is used for arming a fuze, and/or programming a fuze. The provision of such graduated voltage output further improves the safety of the fuze arming system.

FIG. 3 schematically depicts a munition comprising the fuze arming system, in accordance with an example embodiment. The munition 300 comprises an explosive charge 301, a fuze 302, and a fuze arming system 303. The fuze arming system 303 is equivalent to the fuze arming system 100 of FIG. 1. The explosive charge 301 is activated by the fuze 302, causing the ammunition effect—for example, in case of the munition 300 being an artillery round, the exploding thereof. The fuze 302 is the detonator of the explosive charge 301. The fuze arming system 303 is arranged to produce an output indicating that an arming event has occurred in order to enable the fuze 302 to be armed, or to arm the fuze 302 directly. The munition 300 comprises (but is not limited to) artillery shells and charges, missiles, rockets, and mortar rounds, as well as small arms munitions such as bullets.

FIG. 4 schematically depicts a fuze arming method for a munition, in accordance with an example embodiment. In step 401, the method comprises detecting a setback event. As explained above in relation to FIG. 1, the setback force is the rearward force of inertia resulting from the forward acceleration of a projectile (in this case, a munition) during its launching phase, applied in the direction along of the path of travel of the projectile. That is, the setback force is the force generated as the munition is initially accelerated. At least two separate environments must be detected in order to permit arming. Mechanical artillery fuzes typically use separate, independent mechanisms to detect setback and spin. Rotational arming requires that a munition reaches a certain rpm before an arming event occurs. Thus, by detecting a setback event, and using that to indicate that an arming event has occurred, earlier arming might be achieved, which is beneficial in situation where early arming is required—for example, when the munition has a relatively short distance to travel to the target. In step 402, the method comprises the step of, in response the setback event being detected, generating a signal that an arming event has occurred. An arming event is understood as an event representing a point in time at which the fuze may be armed; for example, the munition reaching its peak acceleration. In step 403, the method comprises the step of, in response to the setback event occurring in response to the setback event occurring, producing a graduated output, and using that graduated output. Such graduated output is produced by the sensor before an external power source (that is, a power source used to power components of the munition, separate from the sensor) becomes available, allowing for earlier detection of an arming event. This does not necessarily mean that the fuze can trigger an explosive charge, based on the detection of the setback event, and/or generation of the signal indicating that the arming event has occurred. Other conditions may need to be met. Important is that the generation of the signal indicating that the arming event has occurred may occur before the power source of the fuze is fully activated.

As above, this all means that the sensor is effectively acting as a form of short-term memory, for use in programming post-launch functionality. The sensor is able to provide self-powered signals, and so information and context, about a launch, for use in detecting launch and setting post-launch conditions. This may allow for better safety, but also better target engagement (more accurate, reliable, or simpler implementation). Also, any accumulated energy is used for such detection, programming, and so on, and not necessarily for powering the munition. This means that a discharge route for the accumulated energy (e.g. used in processing the signal) may be intentional, to avoid false triggers due to events immediately prior to loading of the munition. Since the munition may be more generally powered by a separate, main power source (separate to the charge-generating sensor), this could provide additional safety. For example, parts of the fuze controlling initiation may not be powered until after launch. All of this may allow for better compliance with safety standards, or better safety standards.

Although a few preferred embodiments have been shown and described, it will be appreciated by those skilled in the art that various changes and modifications might be made without departing from the scope of the invention, as defined in the appended claims.

The invention claimed is:

1. A fuze arming system for a munition, the fuze arming system comprising:

an arming circuit arranged to detect a setback event and, in response to the setback event, generate a signal indicating that an arming event has occurred;

wherein the arming circuit comprises a sensor configured to produce a graduated, non-binary output to a fuze when the setback event occurs; and wherein a graduation of the graduated, non-binary output is proportional to a degree of setback detected during the setback event, and the graduation of the graduated, non-binary output is used for providing information on one or more launch conditions of the munition.

2. The fuze arming system of claim 1, wherein the graduated output is used for arming the fuze, and/or programming the fuze, the fuze being in connection with or forming part of the fuze arming system.

3. The fuze arming system of claim 1, wherein the graduated output is used for programming the fuze, in addition to arming of the fuze.

4. The fuze arming system of claim 3, wherein the graduated output is used for programming a post-launch arming delay of the fuze.

5. The fuze arming system of claim 1, wherein the one or more launch conditions comprises an approximate muzzle velocity.

6. The fuze arming system of claim 1, wherein the sensor comprises a solid-state sensor, a piezoelectric sensor, or a magnetostrictive sensor.

7. The fuze arming system of claim 1, wherein a sensing axis of the sensor is aligned with a main acceleration axis of the munition.

8. The fuze arming system of claim 1, wherein the arming circuit further comprises:

a capacitor arranged to store a voltage corresponding to the graduated output generated by the sensor.

9. The fuze arming system of claim 8, wherein the arming circuit further comprises: a rectifier; and/or a bleed resistor.

10. The fuze arming system of claim 1, wherein, in response to verifying that an arming event has occurred, the arming circuit is configured to output a signal to arm the fuze.

11. The fuze arming system of claim 10, wherein the fuze comprises an electronic fuze.

12. The fuze arming system of claim 1, wherein the sensor is configured to generate a charge when the setback event occurs.

13. The fuze arming system of claim 1, wherein the sensor is configured to convert mechanical strain to electric charge to produce the graduated, non-binary output before a power source of the munition is activated, wherein the power source is separate from the sensor.

14. A munition comprising the fuze arming system of claim 1.

15. A fuze arming method for a munition, the method comprising:

detecting a setback event;

responsive to the setback event, generating a signal that an arming event has occurred; and responsive to the setback event, producing a graduated, non-binary output to a fuze, wherein a graduation of the graduated, non-binary output is proportional to a degree of setback detected during the setback event, and the graduation of the graduated, non-binary output is used for providing information on launch conditions of the munition.

16. The method of claim 15, wherein the graduated output is used for arming the fuze and/or programming the fuze.

17. The fuze arming system of claim 8, wherein the arming circuit further comprises:

a comparator circuit arranged to compare the voltage stored by the capacitor with a threshold value to verify whether an arming event has occurred.

18. A fuze arming system for a munition, the system comprising:

an arming circuit arranged to detect a setback event and, responsive to the setback event, generate a signal indicating that an arming event has occurred;

wherein the arming circuit includes a sensor configured to produce a graduated, non-binary output to a fuze responsive to the setback event, a graduation of the graduated, non-binary output being proportional to a degree of setback detected during the setback event;

wherein the graduation of the graduated, non-binary output provides non-binary information about one or more launch conditions of the munition; and wherein the fuze arming system is arranged to use the non-binary information to arm the fuze and/or program the fuze.

19. The fuze arming system of claim 18, further comprising the fuze.

20. A munition comprising the fuze arming system of claim 19.

* * * * *